US010581209B2

(12) United States Patent
Byrne et al.

(10) Patent No.: US 10,581,209 B2
(45) Date of Patent: Mar. 3, 2020

(54) PORTABLE POWER OR DATA RECEPTACLE WITH CORD

(71) Applicants: Norman R. Byrne, Ada, MI (US); Daniel P. Byrne, Lowell, MI (US); Joseph D. Ward, Grand Rapids, MI (US)

(72) Inventors: Norman R. Byrne, Ada, MI (US); Daniel P. Byrne, Lowell, MI (US); Joseph D. Ward, Grand Rapids, MI (US)

( * ) Notice: Subject to any disclaimer, the term of this patent is extended or adjusted under 35 U.S.C. 154(b) by 0 days.

(21) Appl. No.: 16/002,629

(22) Filed: Jun. 7, 2018

(65) Prior Publication Data

US 2018/0358762 A1 Dec. 13, 2018

Related U.S. Application Data

(60) Provisional application No. 62/517,615, filed on Jun. 9, 2017.

(51) Int. Cl.

| | |
|---|---|
| ***H01R 13/72*** | (2006.01) |
| *H01R 27/02* | (2006.01) |
| *H01R 31/06* | (2006.01) |

(52) U.S. Cl.

CPC ..... *H01R 13/72* (2013.01); *H01R 27/02* (2013.01); *H01R 31/06* (2013.01)

(58) Field of Classification Search

CPC ..... H01R 13/72; H01R 11/02
USPC ..... 439/501
See application file for complete search history.

(56) References Cited

U.S. PATENT DOCUMENTS

| | | | | |
|---|---|---|---|---|
| D78,966 | S | 7/1929 | Conner | |
| 4,289,366 | A * | 9/1981 | Marks | H01R 24/84 439/293 |
| D325,723 | S | 4/1992 | Gary et al. | |
| D389,459 | S | 1/1998 | Byrne | |
| 6,179,665 | B1 * | 1/2001 | Rossman | H01R 13/72 439/131 |
| 6,427,290 | B1 * | 8/2002 | Liu | B65H 75/36 24/16 R |
| D484,460 | S | 12/2003 | Cheng et al. | |
| D553,306 | S | 10/2007 | Hansen | |
| D614,574 | S | 4/2010 | Thommes | |

(Continued)

OTHER PUBLICATIONS

Co-pending and commonly-owned U.S. Appl. No. 29/674,249, filed Dec. 20, 2018.

(Continued)

*Primary Examiner* — Phuong K Dinh
(74) *Attorney, Agent, or Firm* — Gardner, Linn, Burkhart & Ondersma LLP

(57) ABSTRACT

A portable power or data receptacle includes an electrical cord, a housing body supporting one or more electrical receptacles, and a flexible housing portion that can be used to form a closed loop for retaining portions of the electrical cord. The flexible housing portion has a releasable fastener to selectively hold the flexible housing portion in the closed loop configuration, which allows the flexible housing portion to cooperate with the housing body to secure at least a portion of the cord in an organized manner. The flexible housing portion can also be used to help secure one or more electrical plugs to the electrical receptacle(s), such as to resist inadvertent removal of a plug from a corresponding receptacle.

20 Claims, 2 Drawing Sheets

(56) References Cited

U.S. PATENT DOCUMENTS

| | | | | |
|---|---|---|---|---|
| D700,606 | S | 3/2014 | Lo | |
| D701,836 | S | 4/2014 | Byrne | |
| D714,726 | S | 10/2014 | Byrne et al. | |
| D717,732 | S | 11/2014 | Byrne et al. | |
| D719,508 | S | 12/2014 | Byrne et al. | |
| D736,159 | S | 8/2015 | Byrne et al. | |
| D736,709 | S | 8/2015 | Byrne et al. | |
| D741,266 | S | 10/2015 | Byrne et al. | |
| D744,953 | S | 12/2015 | Byrne et al. | |
| D759,596 | S | 6/2016 | Byrne et al. | |
| 9,373,921 | B1 * | 6/2016 | Lin | H01R 25/003 |
| D761,732 | S | 7/2016 | Byrne et al. | |
| D762,175 | S | 7/2016 | Byrne et al. | |
| D762,176 | S | 7/2016 | Byrne et al. | |
| D807,539 | S | 1/2018 | Li | |
| D811,337 | S | 2/2018 | Byrne et al. | |
| D821,328 | S | 6/2018 | Byrne et al. | |
| 10,116,106 | B2 | 10/2018 | Byrne et al. | |
| D839,828 | S | 2/2019 | Byrne et al. | |

OTHER PUBLICATIONS

Co-pending and commonly-owned U.S. Appl. No. 29/605,930, filed May 31, 2017.

* cited by examiner

PORTABLE POWER OR DATA RECEPTACLE WITH CORD

CROSS-REFERENCE TO RELATED APPLICATIONS

The present application claims the filing benefits of U.S. provisional application Ser. No. 62/517,615, filed Jun. 9, 2017, which is hereby incorporated by reference herein in its entirety.

FIELD OF THE INVENTION

The present invention relates to power and data receptacles and, more particularly, to portable power and data receptacles with electrical cords.

BACKGROUND OF THE INVENTION

Conventional power or data receptacles may be fitted with electrical cords of varying lengths to increase the operational distance of a device from a power or data source. A common example would be extension cords. Extension cords of fixed length, and associated power or data receptacles, allow a user to extend the range of an electrical or electronic device that requires physical connection to power or data. The longer the electrical cord, the greater the potential range. While it is often desirable to carry such receptacles and cords from one location to another, they can be bulky and can present a trip hazard if carried loosely, or if excess cord passes through a walking area.

SUMMARY OF THE INVENTION

The present invention provides a portable power or data unit that allows for excess electrical cord to be bundled and controlled in a safe and organized manner, such as for moving from one location to another, or during periods of non-use or limited use. The portable power and data receptacle allows a user to store unused or unnecessary portions of a fixed length electrical cord to any suitable length by allowing the excess cord to be looped until only the desired length remains, or until substantially the entire cord is secured for storage or transport. The portable power and data receptacle includes a housing body that supports at least one electrical connector and an electrical cord that passes through the housing body to supply electrical energy to the at least one electrical connector. A flexible housing is coupled to the housing body and extends around the housing body and fastens to the housing body to create a loop that extends from the housing body. In this way, one or more portions of the electrical cord can be routed through the loop created by the flexible housing until a desired length of the electrical cord is secured or retained in the loop. The flexible housing may also be used to ensure that electrical plugs associated with electrical power consumers are secured or retained at the electrical connector, either with or without one or more portions of electrical cord passing through the loop.

According to one form of the present invention, a portable power or data unit includes an electrical cord, electrical power or data receptacle, a housing body, and a flexible housing portion. The housing body supports the electrical power or data receptacle, and the power or data receptacle is in electrical communication with the electrical cord, which passes through the housing body. The flexible housing portion has a proximal portion coupled to one side of the housing body and a free distal portion extending outwardly from the housing body. The free distal portion is securable to an opposite side of the housing body in order to form a loop that extends outwardly from the housing body. The loop is configured to receive and secure one or more portions of the electrical cord, such as in a coiled arrangement.

In one aspect, the loop formed by the flexible housing portion can engage and secure a plug that is engaged with the electrical power or data receptacle.

In another aspect, a first fastener portion is positioned at the free distal portion of the flexible housing portion and a second fastener portion is positioned at the opposite side of the housing. The first fastener portion is releasably securable to the second fastener portion in order to form and hold the loop in the flexible housing portion. Optionally, the first and second fastener portions can be releasably secured together in different positions so that the size of the loop is adjustable according to the position of the first fastener portion relative to the second fastener portion.

In yet another aspect, the electrical power or data receptacle includes at least one high voltage AC receptacle and/or at least one low voltage DC receptacle. Optionally, a low voltage DC receptacle may be in the form of a USB receptacle.

Thus, the portable power and/or data unit of the present invention provides a convenient, built-in device for storing or organizing excess electrical cord associated with the receptacle, and which may also be used to help secure one or more electrical plugs to the one or more receptacles of the portable power and/or data unit.

These and other objects, advantages, purposes and features of the present invention will become apparent upon review of the following specification in conjunction with the drawings.

DESCRIPTION OF THE PREFERRED EMBODIMENTS

Figure 1:
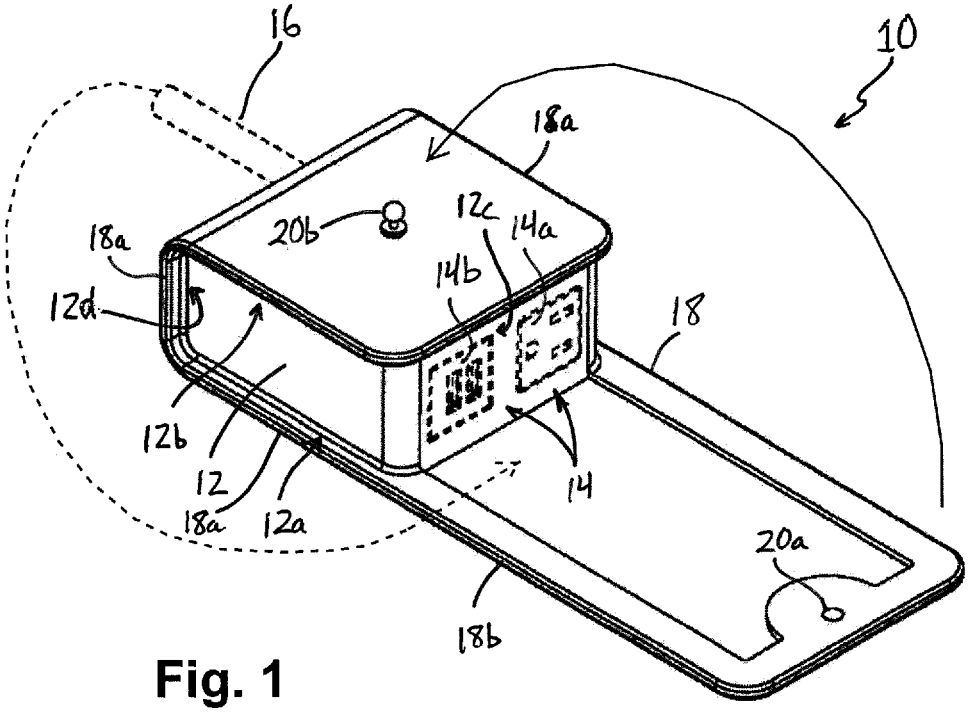
FIG. 1 is a top perspective view of a portable power or data receptacle in accordance with the present invention, shown in an open configuration.
Figure 2:
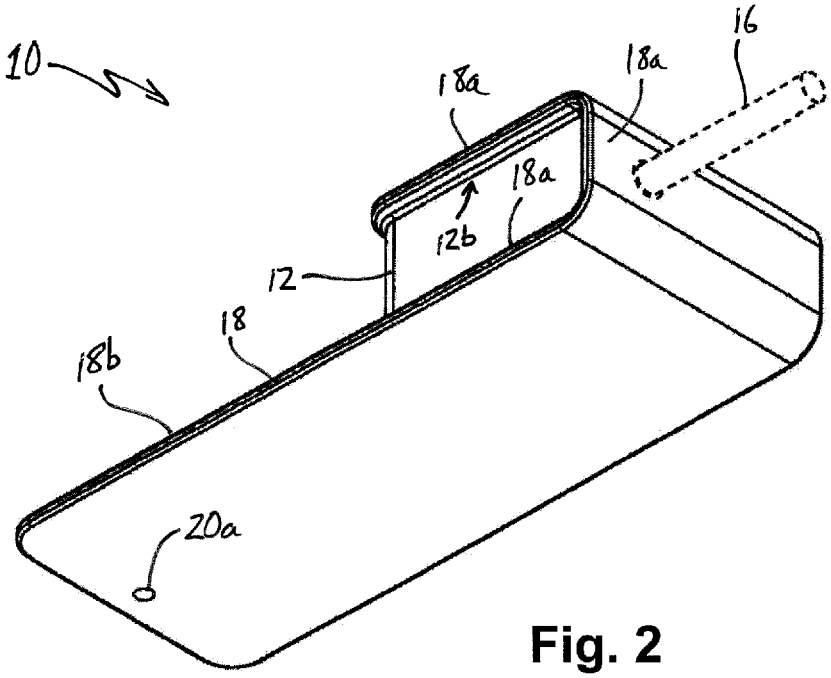
FIG. 2 is a bottom perspective view of the portable power or data receptacle of FIG. 1.

Referring now to the drawings and the illustrative embodiments depicted therein, a portable power or data receptacle 10 includes a substantially rigid housing body 12 having at least one electrical power or electronic data connector or receptacle 14 (FIG. 1). In the illustrated embodiment, both a high voltage 110V AC "simplex" receptacle 14*a* and a low voltage DC receptacle 14*b* having two USB-style charging outlets are provided at housing body 12. The portable power or data receptacle 10 also includes an electrical cord 16 for supplying power to the outlets 14. The electrical cord 16 passes through the housing body 12 and electrically energizes the electrical connectors 14. The incoming power may be converted or transformed as needed, using an onboard power converter such as an AC/DC converter that provides low voltage DC power at DC receptacle 14*b* when cord 16 is configured to receive power from a 110V or 220V AC power source, such as an outlet associated with a building or vehicle electrical system.

Figure 3:
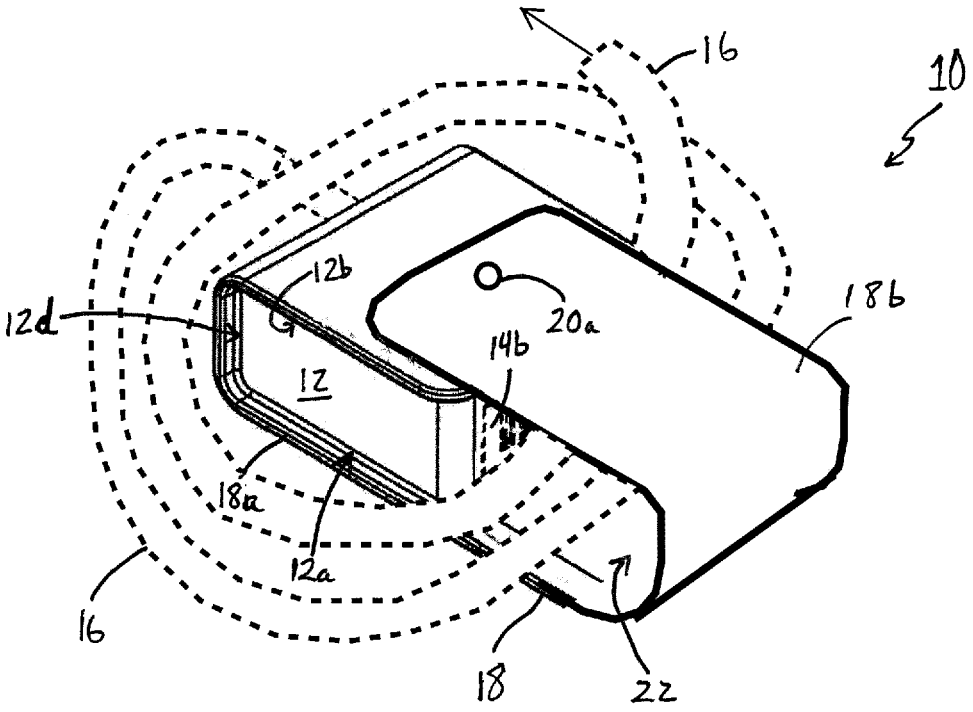
FIG. 3 is another top perspective view of the portable power or data receptacle of FIG. 1, shown in a looped configuration with the flexible housing fastened around the cord.

Disposed at least partially around the housing body 12 is a flexible housing or housing portion 18 that includes a first fastener portion 20*a* and a compatible second fastener portion 20*b*. As shown in FIGS. 1 and 3, the flexible housing 18 has a proximal portion 18*a* coupled to a bottom or first side 12*a* of the housing body 12, and a free or distal portion 18*b* that extends away from the housing body 12. Distal portion 18*b* of flexible housing 18 is sufficiently flexible so that the first fastener portion 20*a* can be coupled to the second fastener portion 20*b* at a top or second side 12*b* of the housing body 12 that is opposite of the first side 12*a*. In this manner, and as shown in FIG. 3, the flexible housing 18 creates an open loop 22 that extends forwardly from a forward surface 12*c* the housing body 12, in front of the receptacles 14. This loop 22 allows for the electrical cord 16 to be wrapped around the flexible housing 18 and the housing body 12 as shown in FIG. 3, for secure storage during transport or periods of non-use. In addition to cord storage, it will be appreciated that the loop 22 may also be used to contain and secure one or more male plugs that are engaged with the receptacles 14, typically when there are no sections of the cord 16 positioned in the loop 22, and the cord 16 is plugged in to a power source. Thus, the flexible housing 18 can be used to provide a strain relief function by reducing mechanical stresses applied to the outlets 14 by the plugs and the cords associated with those plugs.

In the illustrated embodiment, the proximal end 18*a* of the flexible housing 18 is shown to wrap around both the first side 12*a* and second side 12*b* of the housing body, and also a rear side 12*d*. However, it is envisioned that the proximal end of the flexible housing could be secured to the housing body 12 only near the front face 12*c*, in which case the second fastener portion 20*b* could be directly attached to the second side 12*b* of the housing body 12. The distal end portion 18*b* of the flexible housing 18 can be made from substantially any flexible material such as woven textile fabric, genuine or faux leather, rubber or rubber-like material, resinous plastic, rigid panels with one or more hinges, and the like. Moreover, although the term "flexible" is used to refer to the flexible housing 18, it will be appreciated that portions of the flexible housing 18 may be rigid, such as where the flexible housing 18 is attached to the housing body 12, and that only a portion of housing 18 may be flexible in some manner, such as a flexible material or through the use of one or more hinges as described above.

It is further envisioned that the flexible housing 18, or portions thereof, may be unitarily formed as or with portions of the housing body 12. However, the flexible housing 18 may instead be secured, either permanently or temporarily, to one or more outer surfaces of housing body 12, using any appropriate mechanical attachment means such as adhesives, rivets, ultrasonic welding, snap fasteners, magnets, and the like. To the extent that the flexible housing 18 may be permanently attached, it will be appreciated that the flexible housing may be unitarily formed with portions of the housing body, or may be attached using fasteners or a fastening method that cannot be separated without damage.

First fastener portion 20*a* and second fastener portion 20*b* may be any two compatible portions of a fastener that mate or otherwise secure together. For example, snap fasteners, hook and loop fasteners, hook and eye, zippers, magnets, and the like may be used. Additionally, flexible housing 18 may include multiple first fastener portions 20*a* and/or multiple second fastener portions 20*b* at different locations to facilitate forming loops 22 of various sizes, which may be dictated by the length or amount of the electrical cord 16 that is desired to be retained at the loop 22, or to provide a strain relief when different sizes or configurations of plugs are engaged with one or more of the outlets 14.

As shown in the illustrated embodiment, the high voltage AC connector 14*a* may be configured with three receptacle openings for respective hot, neutral, and ground prongs of an electrical plug, although other configurations are also possible, such as for use in different countries having different standard plug configurations. In addition to (or instead of) the USB-style low voltage DC connectors 14*b*, substantially any electronic data connector and/or low voltage power connector may be provided, such as Mini-USB, Micro-USB, HDMI, and the like. The placement of connectors 14 in the figures is illustrative only. It will be appreciated that the connectors 14 may be placed along any side of the housing body 12, and as such may facilitate the use of the receptacle while an electrical cord 16 is secured with loop 22. It should further be appreciated that the term "power", as used herein, may refer to electrical power and/or electronic data capabilities for cords and/or receptacles or connectors, such that the principles of the present invention apply to power-only systems, power-and-data systems, and electronic-data-only systems that do not include electrical power transmission capability, such as for charging portable electrical and/or electronic devices.

Accordingly, the portable power and/or data receptacle of the present invention provides a housing body that supports at least one electrical connector and an electrical cord that passes through the housing body to electrically couple to the electrical connector(s). A flexible housing is coupled to the housing body and extends outwardly from the housing body to form a loop that can be used to secure excess electrical cord that supplies power and/or data to the outlet(s), so that a desired length of the electrical cord is secured or retained in an organized manner, whether for transport or during use.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. A portable power or data unit comprising:

an electrical cord;

an electrical power or data receptacle in electrical communication with the electrical cord;

a housing body configured to support the electrical power or data receptacle, wherein the electrical cord passes through the housing body; and a flexible housing portion having a proximal portion coupled to a first side of the housing body and a free distal portion extending outwardly from the housing body;

wherein the free distal portion is selectively securable to a second side of the housing body that is spaced apart from the first side, to thereby form a loop that extends outwardly from the housing body, wherein the loop is adapted to receive and secure one or more portions of the electrical cord, and wherein the loop is adapted to engage and secure a plug that is received by the electrical power or data receptacle.

2. The portable power or data unit of claim 1, wherein the proximal portion of the flexible housing portion is unitarily formed with the first side of the housing body.

3. The portable power or data unit of claim 2, wherein the proximal portion of the flexible housing portion is unitarily formed with the second side of the housing body.

4. The portable power or data unit of claim 3, wherein the proximal portion of the flexible housing portion is secured to the first and second sides of the housing body via a mechanical attachment.

5. The portable power or data unit of claim 1, wherein the electrical power or data receptacle is mounted at a forward surface of the housing body.

6. The portable power or data unit of claim 1, further comprising a first fastener portion at the free distal portion of the flexible housing portion and a second fastener portion at the second side of the housing, wherein the first fastener portion is releasably securable to the second fastener portion.

7. The portable power or data unit of claim 6, wherein the first and second fastener portions are configured to be releasably secured together at a plurality of different positions so that the size of the loop is adjustable according to the position of the first fastener portion relative to the second fastener portion.

8. The portable power or data unit of claim 1, wherein the electrical power or data receptacle comprises at least one high voltage AC receptacle.

9. The portable power or data unit of claim 8, wherein the electrical power or data receptacle comprises at least one low voltage DC receptacle.

10. The portable power or data unit of claim 1, wherein the electrical power or data receptacle comprises at least one low voltage DC receptacle.

11. A portable power or data unit comprising:

a flexible electrical cord;

an electrical power or data receptacle in electrical communication with the electrical cord;

a rigid housing having a front surface, a rear surface, a pair of side surfaces, and top and bottom surfaces, wherein the electrical power or data receptacle is mounted at the front surface or one of the side surfaces, and the electrical cord passes through the rigid housing at the rear surface;

a flexible housing portion extending forwardly of the front surface from one of the top and bottom surfaces and including a distal end portion that is repositionable relative to the rigid housing;

a first fastener portion at the other of the top and bottom surfaces; and a second fastener portion at the distal end portion of the flexible housing portion and configured to releasably engage the first fastener portion;

wherein the flexible housing portion is configured to be formed into a loop and to cooperate with the front surface to form a passageway in which one or more portions of the flexible electrical cord body are positionable and securable in a coiled shape, and wherein the flexible housing portion is adapted to engage and secure a plug that is received by the electrical power or data receptacle.

12. The portable power or data unit of claim 11, wherein the flexible housing portion is permanently attached to the bottom surface of the rigid housing.

13. The portable power or data unit of claim 12, wherein the flexible housing portion is permanently attached to the top surface of the housing body.

14. The portable power or data unit of claim 11, wherein the electrical power or data receptacle is mounted at the front surface of the housing body.

15. The portable power or data unit of claim 11, wherein the first and second fastener portions are configured to be releasably secured together at a plurality of different positions, whereby the size of the loop is adjustable according to the position of the first fastener portion relative to the second fastener portion.

16. The portable power or data unit of claim 11, wherein the electrical power or data receptacle comprises at least one high voltage AC receptacle.

17. The portable power or data unit of claim 11, wherein the electrical power or data receptacle comprises at least one low voltage DC receptacle.

18. The portable power or data unit of claim 11, wherein the electrical power or data receptacle comprises at least one high voltage AC receptacle and at least one low voltage DC receptacle mounted at said front surface.

19. A portable power or data unit comprising:

an electrical cord;

an electrical power or data receptacle in electrical communication with the electrical cord;

a housing body configured to support the electrical power or data receptacle, wherein the electrical cord passes through the housing body and the electrical power or data receptacle is positioned and accessible at a front surface of the housing body; and a flexible housing portion having a proximal portion coupled to a first side of the housing body and a free distal portion extending outwardly from the housing body;

wherein the free distal portion is selectively securable to a second side of the housing body that is spaced apart from the first side, to thereby form a loop that extends outwardly in the forward direction from the housing body, wherein the loop is adapted to receive and secure one or more portions of the electrical cord and the loop at least partially blocks access to the front surface and the electrical power or data receptacle.

20. A portable power or data unit comprising:

an electrical cord;

an electrical power or data receptacle in electrical communication with the electrical cord;

a housing body configured to support the electrical power or data receptacle, wherein the electrical cord passes through the housing body and the electrical power or data receptacle is positioned and accessible at a front surface of the housing body; and a flexible housing portion having a proximal portion that covers and is coupled to a first side of the housing body, to a rear surface of the housing, and to a second side of the housing opposite the first side, the flexible housing portion further comprising a free distal portion extending forwardly from the housing body;

wherein the free distal portion is unitarily formed with said proximal portion and is selectively securable to a second side of the housing body that is spaced apart from the first side, to thereby form a loop that extends outwardly from the housing body, wherein the loop is adapted to receive and secure one or more portions of the electrical cord.

* * * * *